US005170530A

United States Patent [19]

Kopec et al.

[11] Patent Number: 5,170,530

[45] Date of Patent: Dec. 15, 1992

[54] DOOR CLOSER

[75] Inventors: John Kopec, Blackburn; Christopher M. Cornwell, Higher Wheelton Nr. Chorley, all of England

[73] Assignee: Reilor Limited, England

[21] Appl. No.: 596,199

[22] Filed: Oct. 11, 1990

Related U.S. Application Data

[63] Continuation of Ser. No. 320,217, Mar. 6, 1989, abandoned.

[30] Foreign Application Priority Data

Mar. 10, 1988 [GB] United Kingdom ..... 8805706

[51] Int. Cl.[5] ..... E05F 3/10

[52] U.S. Cl. ..... 16/52; 188/316; 16/57; 16/DIG. 9

[58] Field of Search ..... 16/49, 57, 51, 52, 58, 16/61, 66, 71, 72, 82, 84, DIG. 9, DIG. 17; 188/314, 316, 288

[56] References Cited

U.S. PATENT DOCUMENTS 897,825 9/1908 Flynn ..... 16/61

FOREIGN PATENT DOCUMENTS 1497220 1/1978 United Kingdom .
2044840 10/1980 United Kingdom .
2131119 6/1984 United Kingdom ..... 16/52

OTHER PUBLICATIONS

CRC Handbook of Chemistry and Physics, Forty--eighth edition, 1967-68. pp. F-33, F-38, F-3.

*Primary Examiner*—Richard K. Seidel
*Assistant Examiner*—James Miner
*Attorney, Agent, or Firm*—Dority & Manning

[57] ABSTRACT

A door closer of the kind which acts between a door hinge stile and a hinge jamb has a body for mounting usually in the stile, and from the body a spring-biased tension member extends for anchoring to the jamb. A hydraulic cylinder piston damper is interposed between the tension member and its biasing spring, the damper incorporating no unidirectional valve means and instead its piston being undersized relative to the cylinder by an amount predetermined by the viscosity of hydraulic fluid in the damper so as to allow fluid to flow restrictedly around the piston when the tension member is moved in door-closing and door-opening directions.

14 Claims, 1 Drawing Sheet

DOOR CLOSER

Figure 1:
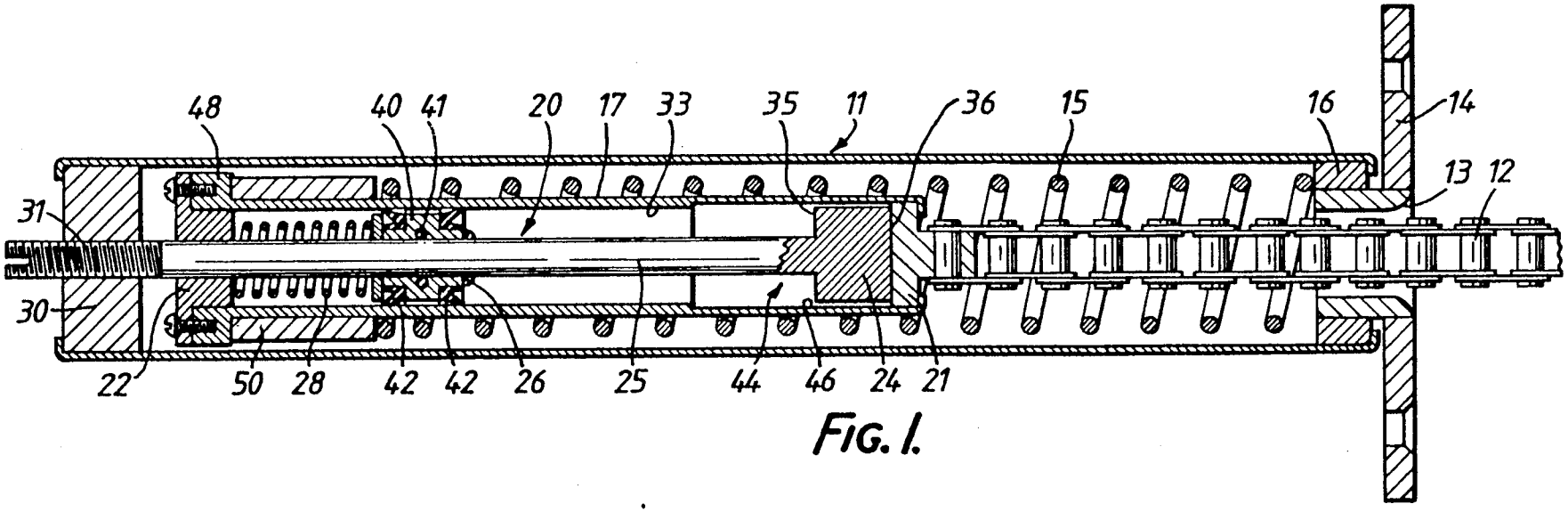

This is a continuation of application Ser. No. 320,217, filed Mar. 6, 1989, now abandoned.

This invention relates to a door closing device for urging an opened door towards its closed position relative to a stationary jamb.

More particularly, the invention concerns improvements in a door closer which is of the kind that acts between the hinge stile of the door and the hinge jamb. This kind of closer has an elongate body from which a tension member extends to an anchor element. The body contains a spring which operates to bias the tension member inwardly of the body, for closing the door. The body is normally installed in a bore in the door stile, when the anchor element is installed in the jamb. Conceivably the positions of the body and anchor element might be reversed. The tension member is flexible and for this an articulated element such as a chain is normally employed.

Door closers of this kind are effective in operation and beneficial insofar as they provide a concealed installation: they are only partially visible when the door is opened.

A possible drawback of these door closers is that they can close a door too quickly causing it perhaps to bump into someone passing through the opened door or to slam.

An object of the invention is to provide a door closer having a decelerated or damped closing action, and at the same time to keep moving parts to a minimum in the interests of simplicity and cost effectiveness.

Door closers, of the general type to which this invention relates, are known wherein hydraulic cylinder/piston dampers are incorporated. These closers, which are marketed by Perkins & Powell PLC, England and Worcester Parsons, England feature unidirectional valve means in their hydraulic dampers. The valve means are intended to allow easy opening by overriding the damping when the door is opened, and to restore damping as soon as the door is released for closing. Such valve means complicate the manufacture of door closers and add significantly to their cost.

We have found that such valve means can be eliminated without making the opening of a door unduly burdensome, for we have now realised that most of the effort required to open the door is directed at stressing the closing spring; in practice, only a little extra effort need be expended in overcoming the hydraulic resistance of the damper. In accordance with one feature of this invention, the hydraulic resistance on opening is minimised by appropriately undersizing the piston relative to its cylinder, in combination with appropriately selecting the viscosity of the hydraulic fluid of the damper.

In accordance with another, though optional, feature of the invention, an end wall of the damper is made movable against and by a biasing spring to compensate for possible in service fluctuations in hydraulic pressure within the damper. The movable end wall may also assist in the manufacture and assembly of the door closer. Further, the movable end wall may help to avoid bubble formation, in use, which could be a source of trouble.

Preferably, according to the invention, the damper features a fluid by-pass operative as the closer approaches a door-closed condition. By means of the by-pass, the damping effect is removed as the door enters its final closing movement, so its spring-driven swinging motion is accelerated. This is to enable the door to overcome latch resistance so as to be closed properly.

Figure 2:
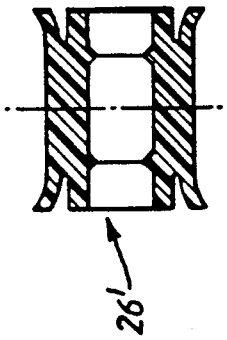

The invention will now be described in more detail by way of example only with reference to and as shown in the accompanying drawing in which:

FIG. 1 is a longitudinal cross-section through a concealed door closer according to the invention, and FIG. 2 is an enlarged cross-section through an alternative embodiment of one of the component parts of the door closer.

The concealed door closer according to the invention comprises (a) a main body 11, (b) an anchor member not shown and a spring-biased tension member 12 extending from the main body 11 and coupled to the anchor member. The main body 11 is for mounting in a bore usually provided in a door stile, a mounting plate 14 at one end of the body being recessed into the stile and screwed thereto as normal. The tension member 12, which could be a flexible steel cable is shown here in the form of a flexible, articulated chain element. Tension member 12 protrudes from an aperture 13 in the aforesaid end of the body 11. It is coupled in any convenient way to an anchor element which also has a mounting plate similar or identical to plate 14. The anchor element is recessed in and secured to the door jamb opposite to the body 11 in the door. The anchor element is not illustrated and will not be described further since exemplary elements are known.

As indicated hereinbefore, the relative positions of the body 11 and the anchor element could be reversed in a suitable installation, the body then being mounted in the door frame or jamb and the anchor element being mounted in the door stile.

Inside the body 11 there is a main spring 15 which acts at one end against a fixed end wall 16 of the body 11. The other end of the spring 15 bears against a movable inner cylinder element 17 the latter having the tension member fastened thereto. The spring 15 is in a state of compression and is thus effective in biasing the tension member inwardly of the body 11. As viewed in FIG. 1, therefore, the spring 15 thrusts the inner cylinder element 17 axially towards the left, or inner, end of the body 11. In use, when a door containing the closer is opened, the door stile swings away from the anchor element set in the door jamb. The tension member 12 is thus pulled outwardly of the main body 11, dragging the inner cylinder element 17 to the right and thereby increasing the compression in the main spring 15. When the opened door is released, the main spring 15 relaxes thrusting cylinder element 17 rearwardly to the left and causes the tension member 12 to be retracted inwardly of the housing. This, of course, has the effect of closing the door.

Apart from the inner cylinder element 17, the structure described so far is substantially the same in its principles of construction and operation as the concealed door closer marketed by REILOR LIMITED under the trade mark GIBCLOSER.

The inner cylinder element 17 is part of a hydraulic damper unit 20. The cylinder element is closed at a front end thereof by a fixed wall 21 which includes an apertured lug to which the tension member 12 is fastened. Its other end is closed by a second fixed wall 22 which is centrally apertured. The damper unit 20 also includes a piston 24 with a piston rod 25, and optionally a movable seal 26 and associated spring 28. The piston 24 is on the inner extremity of the rod 25, which extends rearwardly of the piston through the aperture of wall 22.

Movable seal 26 and its spring 28 being optional, they may be omitted: a fixed seal will then be provided at the aperture of wall 22. The fixed seal can, for example, be an O-ring or equivalent seal capable of establishing a seal between the wall 22 and the piston rod 25.

The rod extends out of the main body 11 through an apertured end plug 30 thereof. The end plug 30 and end portion 31 of the piston rod are matchingly screw-threaded. The screw-threaded interengagement of the end plug 30 and piston rod 25 fixes the rod and piston 24 against axial movement in the damper unit in normal use. The interengagement allows the position of the piston to be adjusted, as may prove necessary, to ensure the door closer is operative to overcome latch resistance when closing the door. To assist in adjusting the damper unit in this way, the outer end of the piston rod 25 is slotted for a screw driver.

The space inside the damper unit 20 which is bounded by the end wall 21, the end wall 22 or movable seal 26 and the cylinder shell is filled with hydraulic fluid. Preferably this is a silicone fluid. Conveniently, it is Dow Corning (RTM) 20 fluid. This fluid is available in a range of viscosity grades which can be blended in varying proportions, as explained in the manufacturer's technical literature, to obtain any chosen viscosity.

The piston 24 is deliberately undersized with respect to the main bore 33 of the cylinder. The undersizing is to permit hydraulic fluid to flow from one side of the piston to the other when the cylinder and piston move relatively in response to door opening and closing movements. Since the main body 11 is secured in the door, and the piston is in use immobile thanks to the screw-threaded connection of its rod 25 to the body end plug 30, opening and closing movements of the door cause the cylinder element 17 to move to and fro relative to the piston 24. The opening movement causes the cylinder element 17 to move outwardly, or forwardly to the right, while the spring-biased closing movement is accompanied by an opposite, rearward movement of the cylinder element.

In use, therefore, during an opening movement the seal end of the cylinder element 17 moves towards rear face 35 of the piston 24. Hydraulic fluid then flows past the piston 24 to occupy the space created between its forward face 36 and the fixed wall 21. The fluid flows in the clearance space around the piston which clearance space results from the undersizing thereof. During a closing movement, the fluid flows in the opposite direction. Ultimately, the cylinder element and piston adopt the positions shown in FIG. 1, which corresponds to the door-closed condition.

Obviously, movement of the cylinder element 17 is opposed by hydraulic resistance. The hydraulic resistance is principally speed responsive. Without wishing to be bound by theory, we would observe that the hydraulic fluid is substantially incompressible and we believe the resistance arises from a shearing of the fluid as it is forced to flow in the aforesaid clearance space. This belief is supported by tests which have shown that the resistance is not significantly different in the door-opening and door-closing directions of operation, when the closer is activated by an identical force in each direction.

With suitably matched fluid viscosity and clearance space, hydraulic hindrance to opening can be insignificant in comparison with the effort needed to compress the spring 15, while adequate damping on closing is attained.

Accordingly, and surprisingly, the unidirectional valve previously considered essential can be omitted entirely. Thus, a complicated valve with moving parts is obviated, easing assembly of the door closer and reducing the manufacturing expense.

Merely by way of example, some dimensional figures will be given for one particular embodiment of the invention. The main bore 33 of cylinder element 17 is 11.9 mm and the total length of the bore is 8.3 cm. The piston 24 is 8 mm long and has a diameter of 11.7 mm and thus is 0.2 mm undersized with respect to the cylinder bore 33. If the piston and cylinder are accurately coaxial (which is not essential) the clearance for fluid flow is 0.1 mm wide or 3.7 $mm^2$ in area. With such a clearance, we have found that a suitable hydraulic fluid is one having a viscosity of the order 7000-7500 cSt ($7\text{-}7.5\times10^{-3}\ m^2/s$). The area of face 35 is 89.4 $mm^2$ and of face 36 is 107.5 $mm^2$, the piston rod having a diameter of 4.8 mm. Overall, the main body 11 has an outer diameter of about 21 mm and a length of some 15 cm.

The invention, of course, is not to be limited to the foregoing dimensions and viscosity, which can be varied recognising that the clearance is increased, a greater viscosity can be tolerated. Matching the clearance and viscosity is a matter of experiment, the aim being to achieve a damped closing movement which is adequately smooth and rapid.

Fluid displacement past the piston 24 may result in pressure fluctuations depending on the direction of movement of the cylinder element 17, due to the difference in effective areas of the opposite piston faces 35, 36. Thus, if the cylinder element 17 is moving forwardly—or rightwardly—the fluid volume swept past the piston towards its larger face 36 is smaller than the volume increase between this face and the wall 21. Likewise, if the cylinder element is moving in the opposite direction, the fluid volume swept past the piston 24 towards its smaller rear face 35 is greater than the increase in volume between the piston and the seal 26. Under these operating conditions, the formation of bubbles in the fluid could occur. To prevent this happening, the damper unit 20 can optionally be adapted to compensate of its own accord for pressure/volume variations. To this end, the unit 20 can include a movable rear wall provided by the optional seal 26. The seal 26 is slidable to and fro on the piston rod 25 and is biased towards the piston 24 by spring 28 compressed between fixed wall 22 and the seal 26.

As shown in FIG. 1, the optional seal 26 comprises a metal or plastics body 40 internally grooved to receive a seal ring—e.g. an O-ring 41—which prevents fluid leakage along the piston rod. A pair of cup seals 42 mounted on the body 40 form a seal with the bore 33 of the cylinder element 17.

The seal 26 need not be as shown in FIG. 1. One alternative is shown in FIG. 2. This is a one-piece element 26' moulded e.g. from an elastomer or a synthetic plastics material such as nylon. It will be seen that one or more ribs encroach on the passage through this seal element, for sealing to the piston rod 25.

In both FIGS. 1 and 2, the seals 26, 26' are symmetrical. This is not essential, since a seal only has to be formed towards the fluid-filled space inside the damper unit 20. Thus, the seals 26, 26' could be constituted merely by the portions to the right of the chain-dotted line of FIG. 2. Nevertheless, the symmetrical form is perhaps to be preferred e.g. from the point of view of simplicity of assembly.

When manufacturing the door closer as shown in the drawings, hydraulic fluid will be introduced via the end of the cylinder 17 to which the end wall 22 will be fitted. The fluid may be introduced before or after the piston 24 is installed, and before the movable seal 26 and associated spring 28 are fitted. Overfilling is to be avoided since it would result in the mechanism locking solid thanks to the essentially incompressible nature of the hydraulic fluid. Simple experiments will determine how much fluid should be used for a given design and size of door closer.

As indicated hereinbefore, the movable seal and spring 28 are not essential. Substitution of a fixed seal in or associated with the end wall 22 simplifies manufacture and can minimise costs. Surprisingly, even with a fixed seal at the end wall 22, the door closer functions entirely satisfactorily and effectively. Conveniently, in this case, the piston 24 is located in the cylinder 17, adjacent the end wall 21 before the hydraulic fluid is introduced. The fluid is filled to a level leaving adequate space for the wall 22 and fixed seal to be installed. Again, simple experiments will determine the optimum amount of fluid required for proper operation.

The damper unit 20 includes a fluid by-pass operative as the closer approaches a door-closed condition. The by-pass 44 is an enlarged, counterbored end portion of the cylinder element 17. The counterbore 46 is located at the end of the cylinder element wherein the piston 24 reposes in the door-closed position. The counterbore may have an internal diameter some 1 mm larger than the piston, and for a piston of axial length about 8 mm, the axial extent of the counterbore can be some 20 mm.

The function of the by-pass 44 is to significantly reduce or effectively remove the hydraulic damping during the final closing stage, by providing an enlarged clearance for fluid to pass around the piston. The effect of the by-pass 44 is to allow the closer spring 15 to accelerate the door as it swings through the last part of its closing movement, to ensure the swinging movement is fast enough that the door can become latched. In other words, the door is accelerated so as to be able to overcome the normal door latch resistance. As a guide, the by-pass may become effective when the door enters the last 20° of its closing swing.

Of course, different door latches offer different latch resistances, and in some instances there may be no latch fitted to the door. To enable the closer to close a door adequately, but not excessively hard, the closer is adjustable to vary the point in the door's closing swing at which the by-pass 44 becomes operative. The adjustment is effected by advancing or retracting the piston 24 and rod 25 axially of the cylinder element 17. The screw-threaded interengagement between the outer end of the piston rod and the body end plug 30 provides for the desired adjustment.

The end wall 21 can be swaged, crimped, indented, brazed or welded to the forward end of the cylinder element. Wall 22 can be secured in a similar manner but, in the illustrated embodiment, is screw fixed to an integral collar 48 encircling the rear end of the cylinder element 17. The end wall 16 and plug 30 may be fitted immovably to the tubular main body 11 in a like fashion.

The mounting plate 14 can be secured to the end wall 16 in any convenient way.

As shown, there is a spacer sleeve 50 between the main spring 15 and the collar 48. This sleeve 50 is a convenient means of establishing a desired initial compression in the spring 15 where this is a stock, bought-in item. The sleeve 50 can be omitted if spring 15 were lengthened.

As described and shown, the damper unit 20 has the piston 24 fixed and the cylinder element 17 movable, the tension member 12 being secured to the latter.

A door closer embodying the invention can, in principle, be designed to have a fixed cylinder element and a movable, spring biased piston and rod to which the tension member is secured.

It will be appreciated that the hydraulic fluid employed in the present damped door closer is significantly more viscous than the fluid that would be used in a conventional door closer whose damper incorporates small-dimensioned, unidirectionally-valved passages. For conventional damped door closers, the conventional, relatively limpid hydraulic fluids such as may be used are likely to have strongly temperature-dependent viscosities.

In contrast, the silicone fluids preferred for this invention are highly viscous. By way of example, the silicone fluids may be blended to have viscosities of 5000 cSt or more, e.g. in the range 5000–12,500 cSt, and these preferred fluids are relatively insensitive to changes in temperature. This temperature-insensitivity is highly beneficial. In-service changes in ambient temperature from day to night, or from season to season, will not seriously affect the damping characteristics, even where the temperature range may be large. Moreover, from a manufacturing standpoint these fluids are beneficial since a given fluid may suit various markets of widely differing climates.

We claim:

1. A door closer for acting between a hinge stile of a door and a hinge jamb comprising:

a body for mounting at one of said stile or said jamb, said body having a first end wall and a second end wall;

a damper carried within said body, said damper comprising a cylinder and a piston carried within said cylinder, said cylinder having hydraulic fluid therein, said cylinder having an inner cavity size exceeding the size of said piston to provide a predetermined clearance for flow of said hydraulic fluid between said piston and said cylinder so that relative movement between said piston and said cylinder allows restricted flow of said hydraulic fluid through said predetermined clearance to create a damping effect during opening and closing of said door without employing a unidirectional valve means to effectuate said damping;

a tension member extending through said first end wall of said body and being in a connecting relationship with said damper, said tension member having an end adapted to anchoring to the other of said stile or said jamb, said tension member being biased toward a door closing position; and one of said piston and said cylinder being in engagement with said second end wall of said body while the other of said piston and said cylinder is in connecting relationship with said tension member so that said damping effect may occur throughout the entirety of both opening and closing of said door.

2. A door closer according to claim 1, wherein said hydraulic fluid has a viscosity of more than about 5000 cSt.

3. A door closer according to claim 1, wherein said piston size is about 98 percent of said inner cavity size and said hydraulic fluid has a viscosity in the range of from about 7,000 cSt to about 7,500 cSt.

4. A door closer according to claim 1, wherein said piston size is about 11.7 mm. in diameter and said inner cavity size is about 11.9 mm. in diameter.

5. A door closer according to claim 1, wherein said tension member is in connecting relationship with said cylinder.

6. A door closer according to claim 1, wherein said piston is in engagement with said second end wall of said body.

7. A door closer according to claim 6 wherein said piston is in engagement with said second end wall of said body via a piston rod extending away from said piston and through said cylinder.

8. A door closer according to claim 1, wherein said cylinder comprises:

(a) a fixed wall enclosing one end thereof;

(b) a moveable seal member spaced from said fixed wall so that said hydraulic fluid is contained within said cylinder; and (c) spring means to urge said seal member toward said fixed wall with movability of said seal member being operative to compensate for pressure/-volume fluctuations in said hydraulic fluid as one of said piston and said cylinder moves relative to the other of said piston and said cylinder.

9. A door closer according to claim 1, wherein the inner cavity of said cylinder is enlarged at an end thereof whereat said piston reposes in a door closed position to provide a fluid by-pass adjacent said end thereof, said by-pass being operative to relieve fluid damping during a final door closing movement of said tension member.

10. A door closer according to claim 1, wherein said tension member comprises an articulated chain element.

11. A door closer according to claim 1, wherein said tension member comprises a flexible cable.

12. A door closer for acting between a hinge stile of a door and a hinge jamb comprising:

a body for mounting at one end of said stile or said jamb, said body having a first end wall and a second end wall, said first end wall defining a bore therethrough;

a piston within said body carried on a piston rod, said piston rod secured to said second end wall of said body and extending toward said first end wall of said body;

a damper carried within said body, said damper comprising a cylinder for receiving hydraulic fluid therein, said cylinder slidably mounted around said piston rod at a distal end of said cylinder, said cylinder having a closed wall at a proximal end thereof defining an inner cavity within said cylinder for enclosing said piston, said inner cavity having a size exceeding the diameter of said piston so that a predetermined clearance between said piston and said cylinder allows for restricted flow of said hydraulic fluid through said predetermined clearance to create a damping effect throughout the entirety of both opening and closing of said door without employing a unidirectional valve means to effectuate said damping;

a tension member secured to said cylinder, said tension member extending through said bore for anchoring to the other of said stile and said jamb; and a spring biased at one end thereof against said first end wall of said body and at an opposite end thereof against said cylinder, said spring being compressed when the door is opened so that the cylinder is pulled toward the first end wall of said body, said spring relaxing when the door is released so that said cylinder is forced toward the second end wall of said body for pulling said tension member toward said second end wall and thereby decreasing the relative distance between said stile and said jamb until said door is closed, said closing of said door being damped by said cylinder to an extent determined by the relationship between said predetermined clearance and the viscosity of said hydraulic fluid.

13. A door closer according to claim 12, wherein said cylinder comprises a moveable seal member opposite said closed wall of said cylinder and wherein said cylinder further comprises spring means to urge said seal member towards said closed wall with movability of said seal member being operative to compensate for pressure-volume fluctuations in said hydraulic fluid as one of said piston and said cylinder moves relative to the other of said piston and said cylinder.

14. A door closer according to claim 12 wherein said inner cavity of said cylinder is enlarged at an end thereof whereat said piston reposes in a door closed position to provide a fluid by-pass at said enlarged end, said by-pass being operative to relieve fluid damping during a final door closing movement of said tension member.

* * * * *